US005188536A

United States Patent [19]

Ganthier et al.

[11] Patent Number: 5,188,536

[45] Date of Patent: Feb. 23, 1993

[54] SPACE-SAVING INSULATION DISPLACEMENT TYPE INTERCONNECT DEVICE FOR ELECTRICALLY COUPLING A RIBBON CONNECTOR TO A PRINTED CIRCUIT BOARD

[75] Inventors: James J. Ganthier; Kirk D. Ulery, both of Spring, Tex.

[73] Assignee: Compaq Computer Corporation, Houston, Tex.

[21] Appl. No.: 851,839

[22] Filed: Mar. 16, 1992

[51] Int. Cl.[5] ..... H01R 9/09

[52] U.S. Cl. ..... 439/83; 439/406; 439/493; 439/499

[58] Field of Search ..... 439/67, 76, 77, 83, 439/329, 391, 393, 395, 396, 401, 406, 409, 426, 427, 435, 440, 492, 493, 498, 499

[56] References Cited

U.S. PATENT DOCUMENTS

| | | | |
|---|---|---|---|
| 3,964,816 | 6/1976 | Narozny | 439/406 |
| 4,927,372 | 5/1990 | Collier | 439/83 |
| 4,978,308 | 12/1990 | Kaufman | 439/83 |

*Primary Examiner*—Paula A. Bradley
*Attorney, Agent, or Firm*—Konneker & Bush

[57] ABSTRACT

A surface mountable insulation displacement type connector for electrically coupling an end portion of a connector ribbon to a spaced series of surface mounted electrically conductive contact pads on a printed circuit board has an elongated base portion through which the central body sections of a longitudinally spaced series of metal contactor pins transversely and slidably extend. The pin body sections have bifurcated, barbed top end portions disposed above a top side of the connector base portion, and transversely enlarged bottom end portions disposed below the bottom side of the base portion. The base portion is secured to the circuit board by soldering the bottom pin end portions to the baord contact pads, with the slidable mounting of the pin body sections automatically compensating for board surface height variations in the region of the surface contact pads. An elongated clamping portion of the connector is snapped onto the base portion to downwardly force the ribbon end portion onto the upper pin ends, thereby locking the ribbon end portion in place on the connector and causing the barbed portions of the upper pin ends to upwardly pierce the ribbon insulation and be brought into conductive contact with its spaced series of embedded electrically conductive wires.

15 Claims, 2 Drawing Sheets

SPACE-SAVING INSULATION DISPLACEMENT TYPE INTERCONNECT DEVICE FOR ELECTRICALLY COUPLING A RIBBON CONNECTOR TO A PRINTED CIRCUIT BOARD

BACKGROUND OF THE INVENTION

1. Field of the Invention

The present invention relates generally to apparatus and methods for operatively coupling electrical components to printed circuit boards, and more particularly relates to apparatus and methods for coupling electrical components to printed circuit boards using ribbon connectors.

2. Description of Related Art

One conventional method of operatively coupling an electrical component to a printed circuit board is to connect one end of a flexible ribbon connector to the component, and secure the opposite end of the ribbon connector to a an outwardly projecting side edge coupling tab portion of the board using a conventional insulation displacement type connector (IDC). A ribbon connector is basically an elongated strip of flexible insulation material in which a laterally spaced series of electrically conductive wires are embedded and longitudinally extend along the length of the insulation strip.

The IDC connector, as conventionally constructed, comprises an elongated rectangular base portion from a top side of which a spaced series of pronged metal connecting members upwardly project. An elongated rectangular clamping member is positioned above and parallel to the base portion and has an upwardly notched rear underside portion that receives an end portion of the connector ribbon. Opposite end portions of the clamping member may be snapped into and releasably locked in corresponding end openings in the base portion in a manner causing the pronged connector members to upwardly pierce the received portion of the connector ribbon insulation and conductively engage the embedded series of wires therein.

The front side of the IDC connector has a slot formed therein into which the circuit board coupling tab may be plugged. Plugging the coupling tab into the IDC connector socket in this manner electrically connects elongated "gold finger" strips formed on side surface portions of the tab to the embedded connector ribbon wires via the pronged connector members and associated conductive structure within the IDC connector socket.

While this conventional plug-in method of coupling a connector ribbon end portion to an edge section of a printed circuit board has been widely accepted and used in the past, it has associated therewith several well known problems, limitations and disadvantages. For example, it requires the use of the aforementioned "gold finger" surface connector strips which are relatively expensive to provide. Additionally, the socket receipt of the circuit board edge coupling tab (an otherwise usable portion of the overall circuit board) effectively dedicates the entire side surface area of the tab (top and bottom) to this single coupling task.

For example, even if the gold finger connector strips are disposed on only one side of the coupling tab, the necessity of plugging the tab into the IDC connector socket to effect the desired coupling of the connector ribbon to the board precludes the use of the opposite side of the tab to operatively mount additional electrical components, and related circuitry, on the board. As printed circuit boards become more complex, and the desirability of reducing their overall size continues to increase, this wastage of otherwise available board space becomes less and less desirable.

It can readily be seen from the foregoing that it would be advantageous to provide improved insulation displacement type connector apparatus, and associated methods, for operatively coupling a ribbon connector end portion to a printed circuit board in a manner eliminating or at least substantially reducing the above-mentioned problems, limitations and disadvantages commonly associated with conventional IDC connectors. It is accordingly an object of the present invention to provide such improved apparatus and methods.

SUMMARY OF THE INVENTION

In carrying out principles of the present invention, in accordance with a preferred embodiment thereof, a uniquely constructed surface mountable insulation displacement type connector is provided for operatively coupling an end of a connector ribbon (and thus an electrical component or subcircuit attached to the other end of the ribbon) to the circuitry of a printed circuit board. To provide a connection interface between the board circuitry and the connector, a row of spaced apart, surface mounted electrically conductive contact pads is appropriately formed on a side of the board.

The connector representatively includes an elongated base portion having top and bottom sides, and a longitudinally spaced series of noncircularly cross-sectioned openings extending through the base portion between such top and bottom sides thereof. These openings slidably but nonrotatably receive the body portions of a series of metal connector pins having bifurcated, barbed upper portions positioned above the top side of the base portion, and laterally enlarged bottom end connector portions disposed beneath the bottom side of the base portion.

To operatively secure the connector base portion to the circuit board, the base portion is positioned over the circuit board contact pads with the bottom pin end connector portions aligned with and engaging the surface mounted board contact pads. The engaged pairs of contact pads and bottom end connector portions are then conductively bonded to one another, illustratively by a soldering process. The slidable mounting of the metal connector pins in the base portion provides automatic compensation for surface height variations of the board side surface in the region of the contact pads.

The improved connector also includes an elongated clamping portion having an underside notch formed therein, and a pair of downwardly projecting end tabs that may be forced downwardly into and locked within corresponding slots formed in the opposite ends of the connector base portion. To operatively secure an end of the connector ribbon to the improved IDC connector, the ribbon end portion is placed in the underside notch of the connector clamping portion, and the clamping portion end tabs are pressed into the base portion slots. This forces the ribbon end portion downwardly onto the barbed upper ends of the connector pins, causing them to upwardly pierce the insulation of the notch-received ribbon end portion, operatively engage the embedded wires within the insulation, and lock the ribbon end portion to the IDC connector.

Because the improved IDC connector of the present invention is surface mountable, and does not require the usual plug-and-socket connection technique found in conventional IDC connectors, it does not require that the circuit board be provided with an outwardly projecting coupling tab portion—the improved IDC connector may be operatively secured to any outer side surface portion of a printed circuit board. Additionally, since the improved IDC connector covers only a portion of one side of the circuit board, the opposite side surface portion of the board remains uncovered and available for the mounting of additional electrical components if desired. Due to the elimination of a board connection socket in the improved IDC connector, it is considerably smaller than conventional IDC connectors of the same wire connection capacity, and also advantageously eliminates the necessity of forming elongated gold fingers on the circuit to electrically couple the board circuitry to the IDC connector.

DETAILED DESCRIPTION

Figure 1:
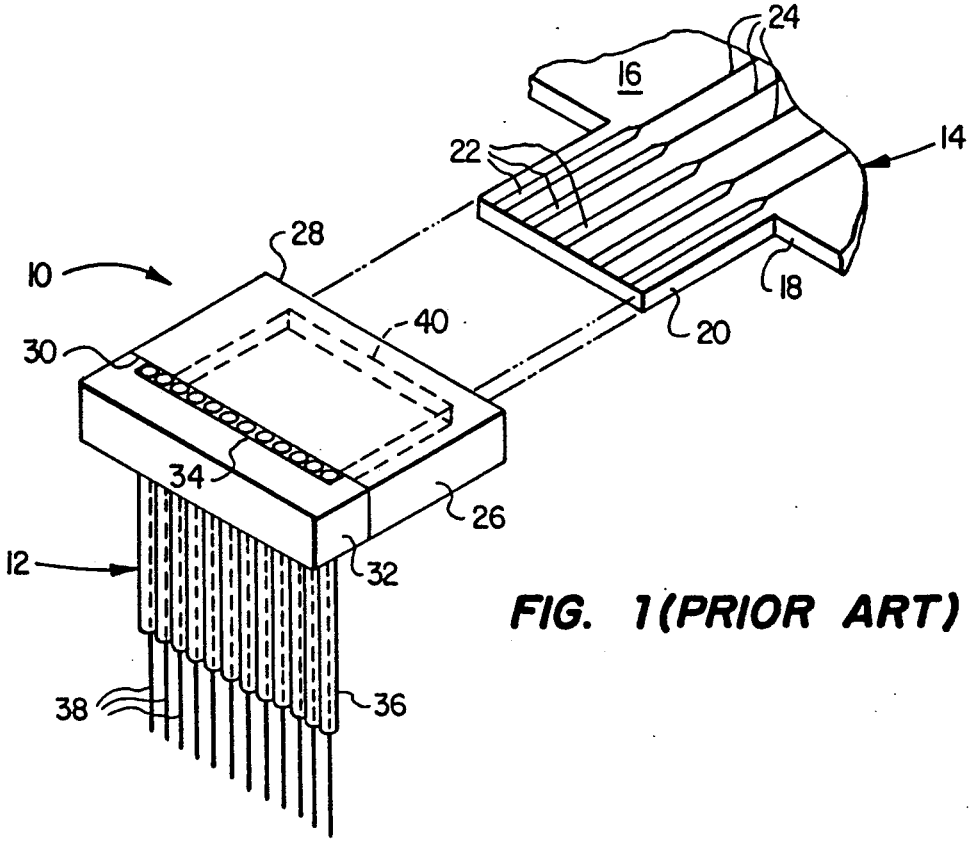
FIG. 1 (PRIOR ART)
FIG. 1 (Prior Art) is an exploded perspective view of a portion of a printed circuit board and a conventional insulation displacement type interconnect device used to electrically couple a ribbon connector to a series of elongated electrical contact strips formed on a side surface of a coupling tab portion of the printed circuit board.

Shown in simplified form in FIG. 1 (Prior Art) is a conventional insulation displacement type connector (IDC) 10 used to operatively couple an end portion of a connector ribbon 12 (and thus an electrical component or subcircuit connected to the opposite end of the connector ribbon) to a printed circuit board 14 having a top side 16 and a side edge 18. To facilitate the interconnection between the connector ribbon 12 and the circuit board 14 in a manner subsequently described herein, the circuit board has formed thereon a rectangular coupling tab 20 that projects outwardly from side edge 18 and has formed on its top side a spaced series of elongated gold conductor strips 22 (commonly referred to as "gold fingers") that extend along essentially the entire projecting length of the tab. The right or inner ends of the gold fingers 22 are operatively connected to the balance of the board circuitry by thinner electrically conductive surface traces 24 formed on the top side 16 of the circuit board 14.

The conventional IDC connector 10 includes an elongated rectangular base portion 26 having a front side edge 28 and a rear side edge 30, and an elongated rectangular clamping portion 32 having a notch 34 formed in its front side, and a front-to-rear width substantially smaller than that of the base portion 26. To operatively secure the upper end portion of the connector ribbon 12 to the connector 10, the ribbon end portion is positioned in the clamping portion notch 34, and barbed tabs (not visible in FIG. 1) on the opposite ends of the clamping portion 32 are forwardly forced into corresponding openings (also not visible) in the rear side of the base portion 26 to lock the clamping portion in place. This compresses the notch-received ribbon end portion and causes barbed metal connector members (not visible in FIG. 1) on the rear side of the base portion 26 to pierce the outer insulation portion 36 of the ribbon and conductively engage the series of conductor wires 38 embedded therein.

The connector 10 is secured to the circuit board coupling tab 20 by plugging the tab 20 into a complementarily configured socket 40 extending inwardly into the front side edge 20 of the connector base portion 26. When tab 20 is plugged into socket 40 in this manner, the gold fingers 22 are operatively coupled to barbed connectors (and thus to the ribbon wires 38) by interior connection structure (not shown) disposed within the socket 40.

This conventional edge connection technique has several disadvantages. For example, the necessary receipt of the tab 20 in the connector socket 40 completely envelopes the tab 20, thereby precluding the mounting of additional electrical components on its underside. Additionally, due to the necessity of providing the socket 40 therein, the conventional IDC connector 10 is of a relatively large size. Moreover, the necessary gold fingers 22 are relatively expensive connection structures since they are actually formed from gold.

Figure 2:
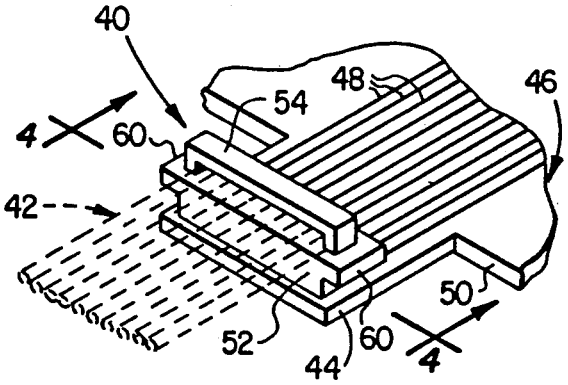
FIG. 2 is an assembled, partially phantomed perspective view of an improved insulation displacement type interconnect device of the present invention being used to electrically couple a connector ribbon to a series of electrical contact pads formed on a side surface of a coupling tab portion of a printed circuit board.

The present invention overcomes these disadvantages by providing a uniquely constructed IDC connector 40 shown in FIG. 2 operatively securing an end portion of a connector ribbon 42 to the coupling tab portion 44 of a printed circuit board 46. To provide a direct comparison between the IDC connectors 10 and 40, the coupling tab 44 is of the same size as the coupling tab 20 shown in FIG. 1.

Several advantageous differences between the improved interconnect structure shown in FIG. 2 and the conventional interconnect structure shown in FIG. 1 are readily apparent. First, the improved IDC connector 40 is considerably smaller than the conventional connector 10. Second, the improved connector 40 mounts entirely on the upper side surface of the coupling tab 44, thereby leaving the entire bottom side surface of the coupling tab 44 free for the mounting of additional electrical components if desired. Third, as will be later described, the coupling tab gold fingers 22 required in the overall interconnect structure of FIG. 1 are eliminated and replaced, for the most part, with considerably less costly conventional electrically conductive surface traces 48 extending across the top side of coupling tab 44. Fourth, the secured connector ribbon 42 exits the IDC connector 40 in a direction parallel to the side surfaces of the circuit board 46 instead of perpendicularly thereto as in the case of the FIG. 1 connector ribbon 12. As will be later described, this facilitates the securement of the connector 40 to the circuit board 46 at a selected position disposed inwardly of its outer side edge 50, thereby permitting the elimination of the normally required coupling tab 44 if desired.

Figure 4:
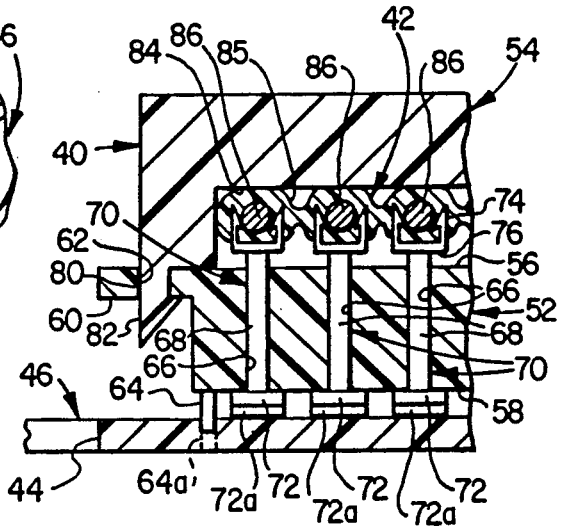
FIG. 4 is an enlarged scale, horizontally foreshortened cross-sectional view through the improved interconnect device, its associated circuit board coupling tab, and the connector ribbon taken along line 4—4 of FIG. 2.
Figure 3:
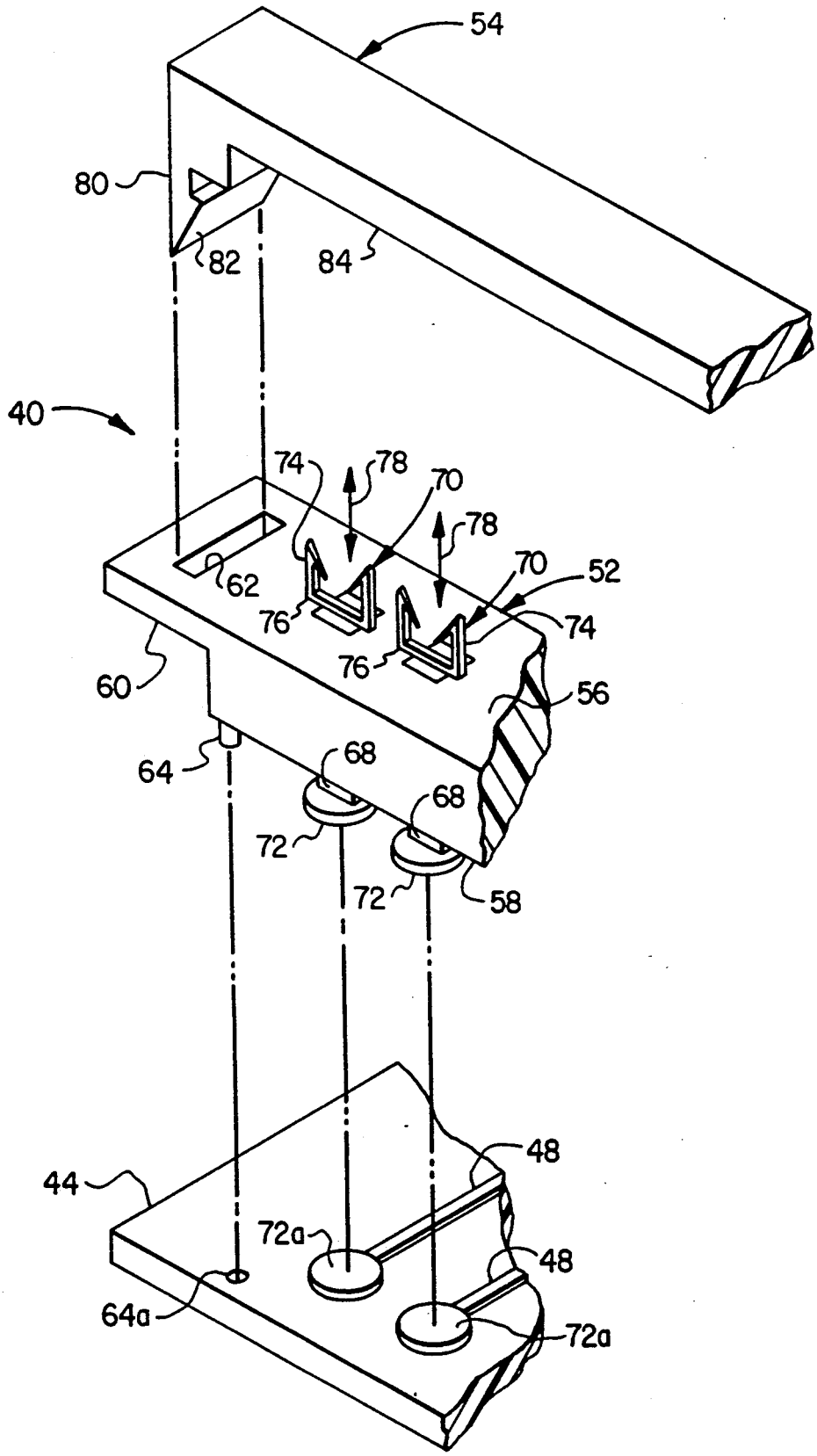
FIG. 3 is an enlarged scale, horizontally foreshortened exploded perspective view of the improved interconnect device and its associated printed circuit board coupling tab.

Referring now to FIGS. 2–4, the IDC connector 40 includes an elongated rectangular plastic base portion 52 that overlies the top side of the coupling tab 44, and an elongated rectangular plastic clamping portion 54 that overlies and longitudinally extends parallel to the length of base portion 52. Base portion 52 has a top side 56, a bottom side 58, opposite end tabs 60 with rectangular slots 62 extending downwardly therethrough, a pair of alignment pin portions 64 projecting downwardly from opposite sides of the bottom side 58, and a longitudinally spaced series of rectangularly cross-sectioned openings 66 (see FIG. 4) each extending downwardly through the base portion 52 between its top and bottom sides 56 and 58.

The rectangularly cross-sectioned openings 66 slidably but nonrotatably receive the rectangularly cross-sectioned body portions 68 of a series of metal, insulation displacement type connector pins 70. The slidably mounted body portions 68 are slightly longer than the vertical distance between the top and bottom sides 56,58 of the connector base portion 52 and have relatively thin connector discs 72 formed on their lower ends, and bifurcated, barbed wire engaging portions 74 formed on their upper ends and having lower sides 76 projecting horizontally outwardly beyond their associated body portions 68. Because the lengths of the body portions 68 are slightly greater than the distance between the top and bottom sides 56,58 of the connector base portion 52, each of the pins 70 is vertically movable a short distance relative to the connector base portion 52, as indicated by the double-ended arrows 78 in FIG. 3.

The clamping portion 54 has a pair of downwardly projecting locking tabs 80 positioned at its opposite ends and having barbed lower ends 82, and an elongated underside notch 84 that terminates at its opposite ends at locations positioned inwardly of the locking tabs 80. As best illustrated in FIGS. 3 and 4, a spaced series of representatively disc-shaped electrically conductive contact pads 72*a*, alignable with the bottom end connector discs 72, are surface mounted on the top side of the coupling tab 44 and connected to the outer ends of the surface traces 48. Also formed on the coupling tab 44 are a pair of alignment through holes 64*a* positioned to downwardly receive the previously described alignment pins 64.

To operatively mount the improved IDC connector 40 on the top side of the coupling tab 44, the connector base portion 52 is positioned atop the coupling tab and the alignment pins 64 are downwardly inserted into their associated coupling tab openings 64*a*, thereby automatically bringing the bottom connector discs 72 of the pins 70 into aligned downward contact with their associated surface mounted contact pads 72*a* as best illustrated in FIG. 4. The associated pairs of discs 72 and contact pads 72*a* are then conductively bonded to one another, preferably by a conventional soldering process. The previously mentioned slight vertical movement capability of the pins 70 relative to the connector base portion 52 automatically compensates for top surface height irregularities existing in the coupling tab 44 along its width—for example if one or more of the contact pads 72*a* is higher or lower than the rest of the contact pads.

To operatively couple the connector ribbon 42 to the metal pins 70, and thus to the contact pads 72*a*, an end portion of the ribbon is inserted into the underside notch 84 of the connector clamping portion 54, and locking tabs 80 are pressed downwardly into rectangular slots 62 until the tab barb lower end 82 snap into place along the undersides of the end tabs 60 as best shown in FIG. 4. This locks the clamping portion 54 in place atop the base portion 52 and also downwardly presses the outer insulation portion 85 of the notch-received section of the connector ribbon 42 against the barbed upper ends of the bifurcated wire engaging portions 74. In turn, this causes the barbed upper pin ends to upwardly pierce the insulation 85 and conductively engage the wires 86 embedded in the insulation 85, as may be best seen in FIG. 4, thereby completing the operative coupling of the connector ribbon 42 to the circuit board 46.

For the sake of illustrative clarity, only a single row of pins 70 has been illustrated as being slidably coupled to the connector base portion 52. It will be readily be appreciated, however, that one or more additional pin rows could be provided in a longitudinally staggered relationship with the illustrated pin row if desired. Also, to provide an easy comparison to the conventional IDC connector shown in FIG. 1, the improved IDC connector 40 of the present invention was shown in FIG. 2 connected to a side surface of the outwardly projecting coupling tab 44. However, another advantage of the improved IDC connector 40 is that it does not require an outwardly projecting coupling tab for its use. Since the connector 40 is surface mountable on a printed circuit board, as opposed to requiring a plug-and-socket connection technique, it may be just as easily secured to a central portion of the board if necessary or desirable.

The foregoing detailed description is to be clearly understood as being given by way of illustration and example only, the spirit and scope of the present invention being limited solely by the appended claims.

What is claimed is:

1. A surface mountable, insulation displacement type connector device for electrically coupling a spaced series of contact pads formed on a side surface of a printed circuit board to an end portion of a connector ribbon having an outer insulation portion in which a spaced series of wires are embedded and extend parallel to the length of said outer insulation portion, said connector device comprising:

a base portion having a first side surface positionable over said contact pads, a second side surface, and a spaced series of openings extending transversely through said base portion from said first side surface to said second side surface;

a spaced series of electrically conductive connector pin members each having:

a longitudinally intermediate body portion received in one of said base portion openings, said longitudinally intermediate body portions of said connector pin members being slightly longer than the distance between said first and second side surfaces of said base portion and being slidably but nonrotatably received in said base portion openings, a transversely enlarged connector section formed on one end of the pin body portion, projecting outwardly beyond said first side surface of said base portion, and being engageable with and conductively bondable to one of said contact pads, and a bifurcated, transversely enlarged barbed portion formed on the opposite end of the pin body portion, projecting outwardly beyond said second side surface of said base portion, and adapted to pierce the insulation portion of the connector ribbon and conductively engage one of the wires embedded therein; and clamping means for inwardly clamping the connecting ribbon end portion inwardly onto said bifurcated, barbed end portions of said connector pin members in a manner causing them to pierce the outer insulation portion of said connector ribbon and conductively engage end portions of the wires embedded therein.

2. The surface mountable, insulation displacement type connector device of claim 1 wherein said base portion openings and said longitudinally intermediate portions of said connector pin members have rectangular cross-sections along their lengths.

3. The surface mountable, insulation displacement type connector device of claim 1 wherein:

said circuit board has a spaced pair of alignment openings extending transversely therethrough, and said base portion has a spaced pair of alignment pins projecting outwardly from said first side surface thereof, said alignment pins being insertable in said alignment openings to bring said connector portions of said connector pin members into operative registry with said contact pads on said printed circuit board.

4. The surface mountable, insulation displacement type connector device of claim 1 wherein:

said base portion has an elongated rectangular configuration with slots formed in opposite end portions thereof and extending inwardly through said second side surface thereof, and said clamping means include an elongated rectangular clamping portion positionable over said base portion in a parallel relationship therewith, said clamping portion having an underside notch configured to transversely receive the connector ribbon end portion, and transverse, barbed end tabs configured to be lockingly inserted into said base portion slots.

5. The surface mountable, insulation displacement type connector device of claim 4 wherein:

said base portion has a pair of longitudinally outwardly projecting opposite end tabs, and said slots are formed in said base portion end tabs.

6. Printed circuit board apparatus comprising:

a printed circuit board having a spaced series of electrically conductive contact pads formed on a side surface thereof;

a connector ribbon having an outer insulation portion in which a spaced series of electrically conductive wires are embedded and longitudinally extend parallel to the length of said outer insulation portion; and an insulation displacement type connector device mounted on said side surface of said printed circuit board and electrically coupling the connector ribbon wires to said contact pads, said connector device including:

a base member overlying said contact pads and having a first side surface facing said contact pads, an oppositely facing second side surface, and a spaced series of openings aligned with said contact pads and extending through said base member between said first and second side surfaces thereof, a series of electrically conductive connector pin members having longitudinally intermediate body portions received in said base member openings, said longitudinally intermediate body portions of said connector pin members being slightly longer than the distance between said first and second side surfaces of said base member and being slidably but nonrotatably received in said base member openings, transversely enlarged connector sections projecting outwardly beyond said first side surface of said base member and conductively bonded to said contact pads, and bifurcated, transversely enlarged barbed portions projecting outwardly beyond said second side surface of said base portion, and a clamping member outwardly overlying said second side surface of said base member, said clamping member being secured to said base member and holding an end portion of said connector ribbon against said bifurcated, barbed portions of said connector pin members with said bifurcated, barbed portions piercing the connector ribbon end portion insulation and conductively engaging the wires embedded therein.

7. The printed circuit board apparatus of claim 6 wherein said base member openings and said longitudinally intermediate portions of said connector pin members have rectangular cross-sections along their lengths.

8. The printed circuit board apparatus of claim 6 wherein said printed circuit board has a spaced pair of alignment openings extending transversely therethrough, and said base member has a spaced pair of alignment pins projecting outwardly from said first side surface thereof and received in said alignment openings.

9. The printed circuit board apparatus of claim 6 wherein:

said base member has an elongated rectangular configuration with slots formed on opposite end portions thereof and extending inwardly through said second side surface, said openings are spaced apart along the length of said base member, and said clamping member has an elongated rectangular configuration, an underside notch receiving said connector ribbon end portion, and transverse, barbed end tabs lockingly received in said base member slots.

10. The printed circuit board apparatus of claim 9 wherein:

said base member has a pair of longitudinally outwardly projecting opposite end tabs, and said slots are formed in said base member end tabs.

11. A space-saving method of electrically coupling a connector ribbon to a spaced series of electrically conductive contact pads mounted on a side surface of a printed circuit board, said connector ribbon having an outer insulation portion in which a spaced series of electrically conductive wires are embedded and longitudinally extend parallel to the length of said outer insulation portion, said method comprising the steps of:

providing a base member having first and second opposite side surfaces, and a spaced series of openings each extending between said first and second side surfaces, said openings being aligned with said contact pads;

captively retaining longitudinally intermediate portions of a series of electrically conductive connector pin members in said openings, said connector pin members having transversely enlarged connector sections projecting outwardly beyond said first side surface of said base member, and bifurcated, transversely enlarged barbed portions projecting outwardly beyond said second side surface of said base member, said longitudinally intermediate connector pin member portions having lengths slightly longer than the distance between said first and second side surfaces of said base member, and said captively retaining step being performed in a manner slidably but nonrotatably disposing said longitudinally intermediate connector pin member portions in said base member openings;

positioning said base member over said contact pads with said connector sections of said pin members in aligned engagement with said contact pads;

conductively bonding said connector sections of said pin members to said contact pads; and pressing an end portion of said connector ribbon inwardly against said barbed portions of said connector pin members in a manner causing said barbed portions to pierce the insulation of said connector ribbon end portion and conductively engage the wires embedded therein.

12. The space-saving method of claim 11 wherein said step of slidably but nonrotatably disposing said longitudinally intermediate connector pin member portions in said base member openings includes the step of providing said base member openings and said longitudinally intermediate connector pin member portions with rectangular cross-sections along their lengths.

13. The space-saving method of claim 11 wherein said positioning step includes the steps of forming a spaced pair of alignment openings through said printed circuit board, forming a spaced pair of alignment pins on said base member, and inserting said alignment pins into said alignment openings.

14. The space-saving method of claim 11 wherein said conductively bonding step is performed using a soldering process.

15. The space-saving method of claim 11 wherein said base member has an elongated configuration and said pressing step includes the steps of:

forming slots in opposite end portions of said base member, providing an elongated clamping member having an underside notch and a pair of barbed, transverse opposite end tabs, placing said connector ribbon end portion in said notch, and snapping said clamping member end tabs into said base member end slots.

* * * * *

UNITED STATES PATENT AND TRADEMARK OFFICE

CERTIFICATE OF CORRECTION

PATENT NO. : 5,188,536
DATED : February 23, 1993
INVENTOR(S) : Ganthier, James J., et al.

It is certified that error appears in the above-identified patent and that said Letters Patent is hereby corrected as shown below:

Title Page:
In the Abstract - line 13, "baord" should be --board--.

Column 1, line 20, delete "a".

Signed and Sealed this

First Day of February, 1994

*Attest:*

Bruce Lehman

BRUCE LEHMAN

*Attesting Officer*

*Commissioner of Patents and Trademarks*